United States Patent [19]

Tamaru et al.

[11] 4,175,372

[45] Nov. 27, 1979

[54] ELECTRONIC TIMEPIECE

[75] Inventors: Munetaka Tamaru, Tokyo; Kazunari Kume; Minoru Watanabe, both of Tokorozawa; Hideshi Ohno, Sayama; Minoru Natori, Nishitama, all of Japan

[73] Assignee: Citizen Watch Co. Ltd., Tokyo, Japan

[21] Appl. No.: 778,159

[22] Filed: Mar. 16, 1977

[30] Foreign Application Priority Data

Mar. 16, 1976 [JP] Japan ..... 51-28253

[51] Int. Cl.[2] ..... G04B 19/24; G04B 27/00; G04C 21/32

[52] U.S. Cl. ..... 58/5; 58/4 A; 58/58; 58/85.5; 58/153

[58] Field of Search ..... 58/4 A, 5, 58, 23 R, 58/85.5, 153

[56] References Cited

U.S. PATENT DOCUMENTS

| | | | |
|---|---|---|---|
| 1,813,777 | 7/1931 | Stack | 58/153 X |
| 3,815,351 | 6/1974 | Vovelle | 58/58 |
| 3,875,741 | 4/1975 | Hastings | 58/153 X |
| 3,911,665 | 10/1975 | Berkum | 58/58 |

*Primary Examiner*—Edith S. Jackmon
*Attorney, Agent, or Firm*—Sherman & Shalloway

[57] ABSTRACT

An electronic timepiece is disclosed which has at least one display function in addition to an ordinary time display function and comprises a sole electro-mechanical transducer for dividing a kept time and driving a first display function and a second display function separately.

14 Claims, 6 Drawing Figures

ELECTRONIC TIMEPIECE

BACKGROUND OF THE INVENTION

This invention relates to an electronic timepiece having an additional or optional function is addition to an ordinary time display function.

Description of the Prior Art

Heretofore, when there is added to a timepiece such second function as calendar, chronograph, world timepiece, a display of high and low tides and biorhythm display and the like, the driving power of an electromechanical transducer is simultaneously used at least for a certain period for the first function as an ordinary time display and the second function as set forth above. Such a conventional timepiece has two brief defects. One of the defects is to have to add further driving power required by the second function to the driving power for the first function. This results in wasting the driving power and thereby overworking the electromechanical transducer. The other of the defects is to rise the requirement that the first and second functions are made in relation to each other since the first and second functions branch from the same system. Therefore the timepiece is affected with restraints in the characteristics of rotation, rotating power, timing, etc. and its arrangement.

Objects of the Invention

An object of this invention is to provide an electronic timepiece in which the above mentioned defects are obviated.

Another object of this invention is to provide an electronic timepiece in which the first and second functions are separately driven by means of a single electromechanical are separately driven by means of a single electromechanical transducer.

These and further objects and advantages of the invention will be more apparent upon reference to the following specification, claim and appended drawings.

DETAILED DESCRIPTION OF THE INVENTION

Figure 1:
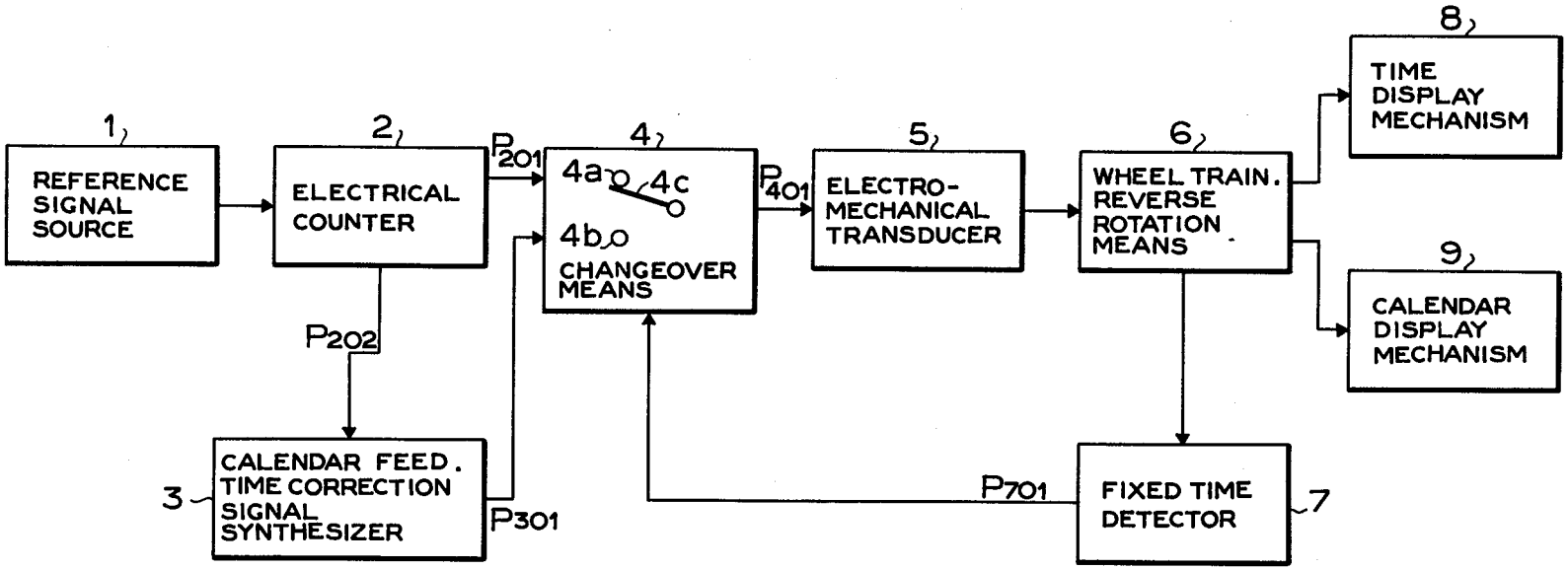
FIG. 1 is a block diagram showing one embodiment of this invention.

FIG. 1 is a block diagram showing a principle of this invention in which reference numeral 1 denotes a reference signal source including an oscillating circuit and crystal oscillating element and 2 depicts an electrical counting means which receives an output from the reference signal source 1 and divides the frequency of the output into a required frequency so as to deliver 1 Hz signal for a timepiece pulse P201 from one input terminal to a changeover means 4 and so as to deliver 32 Hz pulse P202 from the other input terminal to a calendar feed and time correction signal synthesizing means 3. This calendar feed and time correction signal synthesizing means 3 generates pulses programmed such that the electromechanical transducer 5 is driven in the reverse direction of time display driving for 58 seconds and is driven in the direction of the time display driving for 2 seconds. Reference numeral 5 illustrates an electromechanical transducer which rotates in the forward or reverse direction by a driving pulse P401 from the changeover means 4 so as to deliver the rotation to wheel trains and reverse rotation means 6. The wheel trains and reverse rotation means 6 is arranged such that it rotates only a time display mechanism 8 when it is about to rotate time display mechanism 8 in the clockwise direction and such that it rotates only a calendar display mechanism 9 when it is about to rotate the calendar mechanism 9 in the counter-clockwise direction. A determined time detection means 7 detects from the wheel trains and reverse rotation means 6 the time once every two rotations of an hour wheel 28 in detail when it is 24 hours so as to changeover the changeover means 4. The changeover means 4 returns it to an ordinary timepiece pulse P201 after the termination of the calendar feed and time correction signal pulse P301.

Figure 2:
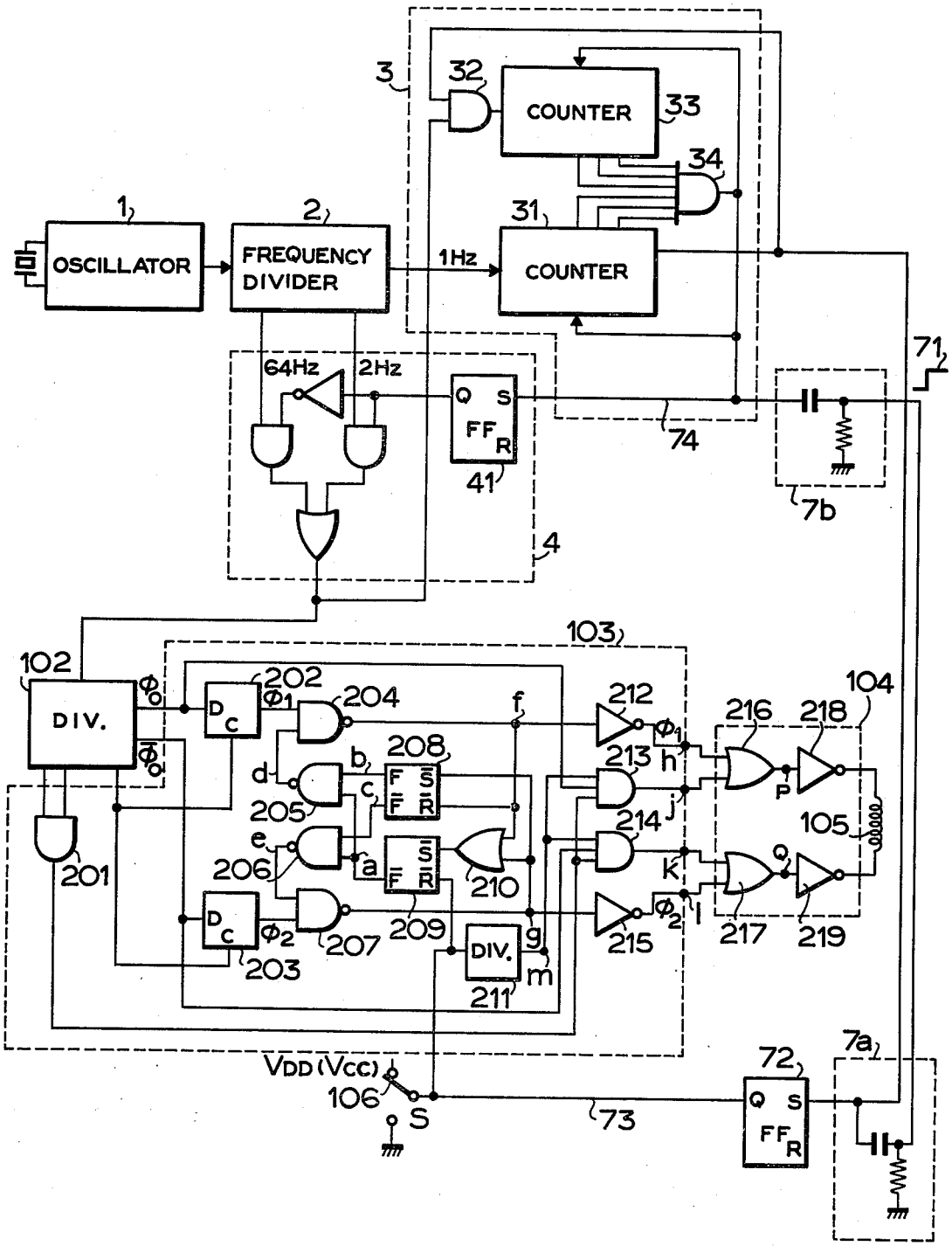
FIG. 2 is a detailed circuit diagram of FIG. 1.

FIG. 2 is a detailed circuit diagram showing an embodiment of this invention in FIG. 1. Reference numeral 103 depicts a wave form converter as an inverter for reversely rotating the electro-mechanical converter 5.

A determined time cam 17 and detection pawl 18 cause a signal 71 to generate and thereby a pulse being generated at a leading edge thereof in a differenciating circuit *7a* composed of a capacitor and a resistor. The pulse inverts a flip-flop 72 so as to invert a potential at a line 73 and to serve to reversely rotate the converter 105. In the differentiating circuit *7b*, there is simultaneously generated a pulse so as to invert and changing over the changeover circuit 4 and thereby 64 Hz signal being delivered to the frequency divider. As the result, the wave form converter 103 causes the pulse motor to reversely rotate by 32 Hz signal and thereby feeding the calendar plate. On the other hand, 1 Hz signal is delivered to the counter 31 so that a signal with 59 count may be generated. As the result, the flip-flop 72 is inverted and thereby making the wave form converter 103 become at the forward feeding condition. And the pulse motor rotates in the forward direction by a 32 Hz signal to correct the lag of the kept time. The signal with the 59 count is applied to AND gate 32 and simultaneously the counter 33 counts 64 Hz signal. When the counted number becomes 59, a coincidence signal with that of the counter 31 is transmitted to the line 74 so as to invert a flip-flop 41 and thereby changing over the changeover circuit 4. Then 2 Hz signal is delivered to the frequency divider 102 to effect normal time feeding. The coincidence detection signal resets the counters 31, 33 so as to return it to the initial state.

In this embodiment, the wave form converter 103 is connected to an externally operating switch 106 and further connected through a driving circuit 104 to a driving coil 105 of the pulse motor.

The wave form converter 103 comprises frequency dividers 202, 203, 211, AND gates 204 to 207, OR gate 210, inverter 212, 215. The driving circuit 104 comprises OR gate 216, 217 and driving inverter 218, 219.

The switch 106 is associated with an externally operating member such as a winding crown and is connected to the high potential side of a power supply source. The output terminal a of the flip-flop 209 is always at zero volt while the output terminals d, c of NAND gate 205, 206 are at 1 volt. Therefore, the input signals $\phi_1$, $\phi_2$ are applied through the NAND gates 204, 207 and inverter 212, 215 to the OR gates 216, 217 of the driving circuit 104 and thereby alternative pulse current with two phase flows through the driving coil 105 and as the result, the pulse motor rotates in the forward direction.

To rotate the pulse motor in the reverse direction, the switch 106 may be changed over to the low potential (the earth) side of the power supply source so that the signal S may be at zero volt and as the result, the potential of the output terminal a of the flip-flop 209 becomes at 1 volt. In this state, the potential of the output terminal b of the flip-flop 208 has been 1 volt by the previously applied input signal $\phi_2$ and the potential of the output terminal d of the NAND gate becomes at zero. Thus the input signal $\phi_1$ is inhibited by NAND gate 204. While the output m of the flip-flop 211 becomes at 1 volt and there appears at the output terminals j,k of AND gate 213, 214 the output product of the output signals $\phi_O$, $\overline{\phi_O}$ of the frequency divider 102 and that of AND gate 201 and thereby being applied through OR gate 216, 217 to the driving inverters 218, 219.

While the other terminal c of the flip-flop 208 has been at zero volt and output terminal e of NAND gate is at one volt. As the result, the input signal $\phi_2$ passes through NAND gate 207 so that the pulse $\overline{\phi_2}$ appears at the output terminal g. This pulse $\overline{\phi_2}$ causes the output terminal a to reset at zero volt and then the signal $\phi_1$ can be passed through so that the signal $\phi_2$ may be applied to the driving circuit 104. As the result, the pulse motor is rotated in the counter-clockwise direction.

Figure 3:
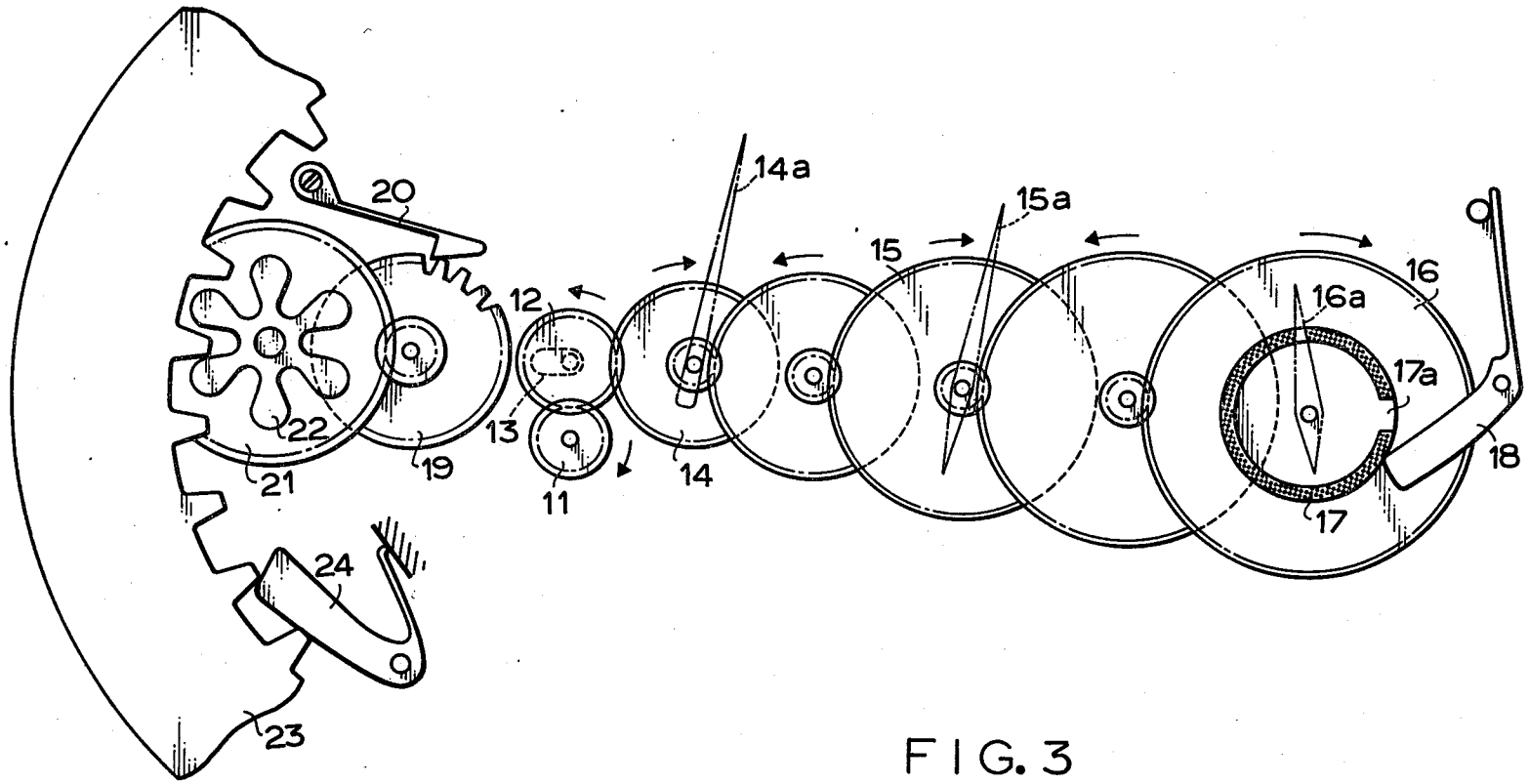
FIGS. 3 and 4 are explanatory views of mechanical parts of FIG. 1.

FIG. 3 is a plan view of a driving condition of the time display mechanism 8 in which reference numeral 11 depicts a pinion secured to the electro-mechanical transducer 5, rotating in the clockwise direction and engaged with a reverse rotation wheel 12. The reverse rotating wheel 12 is engaged with a guide groove 13 formed at a substrate (not shown), engaged with a second wheel 14 provided with a second hand **14*a* of the time display mechanism 8 by engaging pressure, but not engaged with a date rotating wheel 19. Reference numeral 15 denotes minute hand wheel provided with a minute hand 15*a* and 16 illustrates an hour hand wheel provided with an hour hand. A fixed time cam 17 is insulated except a conductive part 17*a* with which a detection pawl is contacted. Reference numeral 19 depicts a date rotating wheel associated with the calendar display mechanism 9 with which reverse rotation preventing spring 20 is engaged, 21 a date wheel provided with a date cam 22, 23 a date display member, and 24** a date display plate position defining lever.

Figure 4:
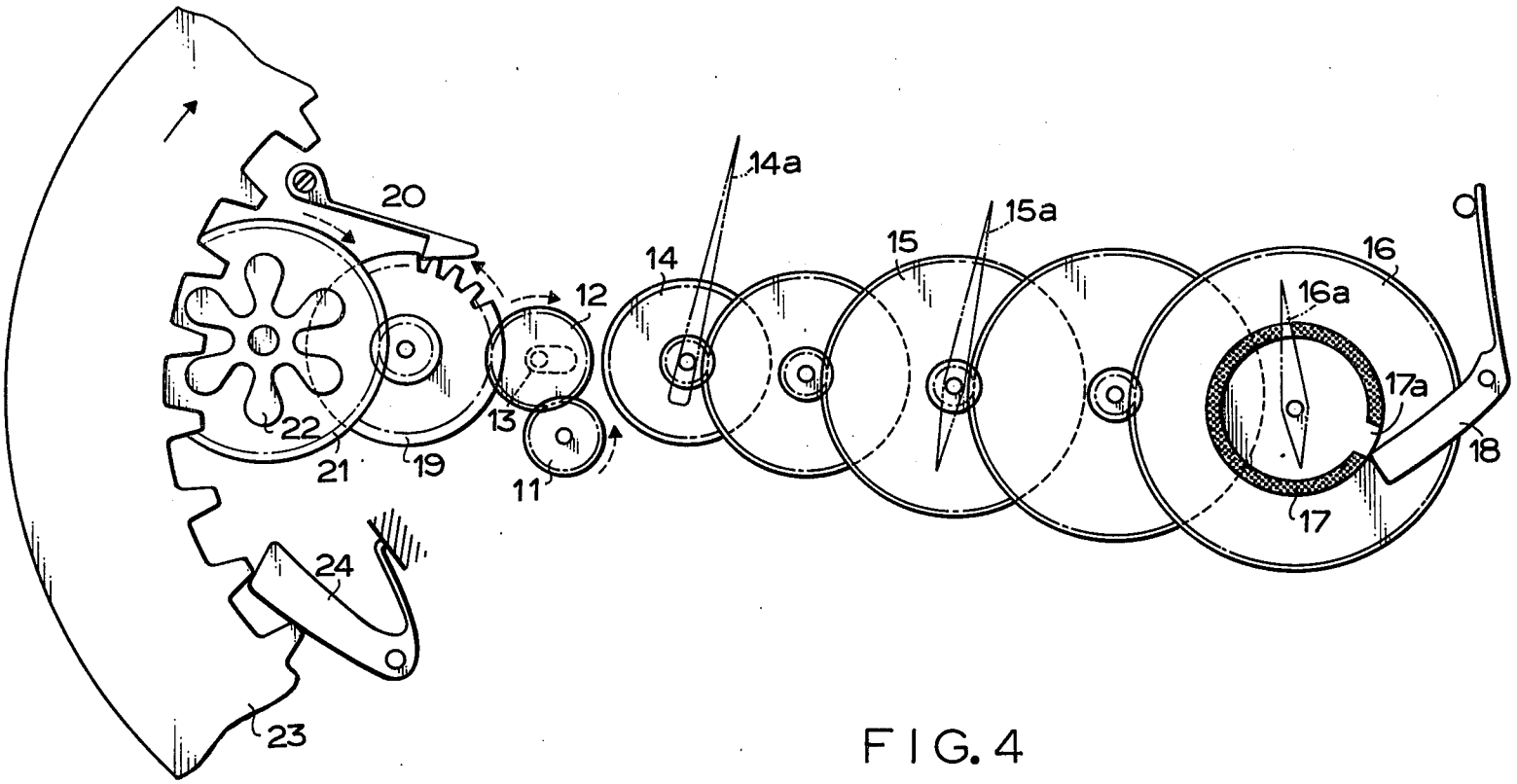

FIG. 4 is a plan view of a driving state of a calendar display mechanism 9 in which the pinion 11 rotates in the counter-clockwise direction, making the reverse rotating wheel 12 engaged with the date rotating wheel 19 by the engaging pressure so as to cause separation of engagement with the second hand wheel 14. Thus the date rotation transmitting wheel 19 rotates the date rotating wheel 21 so as to drive the date member 23.

Hereinafter the operation of the above embodiment of this invention will be described in detail. From 0 hour 6 minutes to 24 hours, the state of FIG. 2 shows such a conditon that the detection pawl 18 is positioned at a place other than the conductive portion **17*a* of the fixed time cam 17 and the switch 4*c* in the changeover means 4 (FIG. 1) is connected to the contact 4*a* at an ordinary time. Therefore, the electromechanical transducer 5 receives a 1 Hz count pulse P201 from the electric counting means 2 to rotate and thereby the engaging pressure making the reverse rotation wheel 12 engaged with the second hand wheel 14 to rotate it once every minute. The decelerated minute hand wheel 15 and hour hand wheel 16 effect normal minutes and hours. At this time the reverse rotation wheel 12 is detached from the date rotation wheel 19 and the date display plate 23 of the calendar display mechanisms 9** is kept in non-operation.

When 12 hours midnight is over, the mechanism becomes the state shown in FIG. 4 under which the detection pawl 18 comes into contact with the conductive protion **17*a* of the fixed time cam 17 so that the fixed time detecting means 7 may operate to transmit the fixed time signal P701. As the result, the switch 4*c* of the changeover means 4 is changed over to the contact 4*b* upon feeding the calendar. Thus, the electro-mechanical transducer 5 is driven by the pulses P301 from the calendar feeding and time correction signal synthesizing means 3. Since there are generated 32 Hz pulses in the counter-clockwise feeding direction from 12 hours 1 second midnight to 12 hours 58 seconds, the pinion 11 of the electromechanical transducer 5 rotates at high speed in the counterclockwise direction so as to make the reverse rotation wheel 12 deengaged from the second hand wheel 14 and thereby causing the reverse rotation wheel 12 to be engaged with the date rotation wheel 19 as the result, the date display plate 23 is driven a little through the date rotation cam 22. While the second hand 14*a*, minute hand 15*a* and hour hand 16*a* are kept in non-operation. There are generated 32 Hz pulses in the clock wise direction from 12 hours 58 seconds midnight to 12 hours 1 minute. The pinion 11 makes the reverse rotation wheel 12 disengaged from the date rotating wheel 19 and engaged with the second hand wheel 14 again and thereby advancing the second hand 14*a* by one minute to make the time display at 12 hours 1 minute. Since the reverse rotation preventing spring 20 is engaged with the date rotating wheel 19, it is not returned by the counter force of the date display position determining lever 24 so that the calendar mechanism 9** is kept in non-operation.

From 12 hours 1 minute to 12 hours 1 minute 58 seconds, there is generated a pulse in the counter clockwise feeding direction.

Returning to the state of FIG. 2, the calendar display mechanism 9 continued to be driven. When it is at 12 hours 1 minute 58 seconds, it returns to the clockwise direction and makes the second hand **14*a* at 12 hours 2 minutes. After the lapse of 6 minutes from 12 hours midnight and the operation is repeated six times, the date display plate 23 completes the feeding for one day. Then, correcting the time spent for changeover operation and adjusting the kept time to the correct time, the switch 4*c* of the changeover means 4** returning to the contact at a normal time and normal state is effected.

When the timepiece is seen from the exterior thereof, the second hand repeats the operation of the stopping for 58 seconds or so and fast feeding for 2 seconds or so. In the interior of the timepiece, the second function of the calendar is given by utilizing the period of the stopping of the second hand **14*a***.

Figure 5:
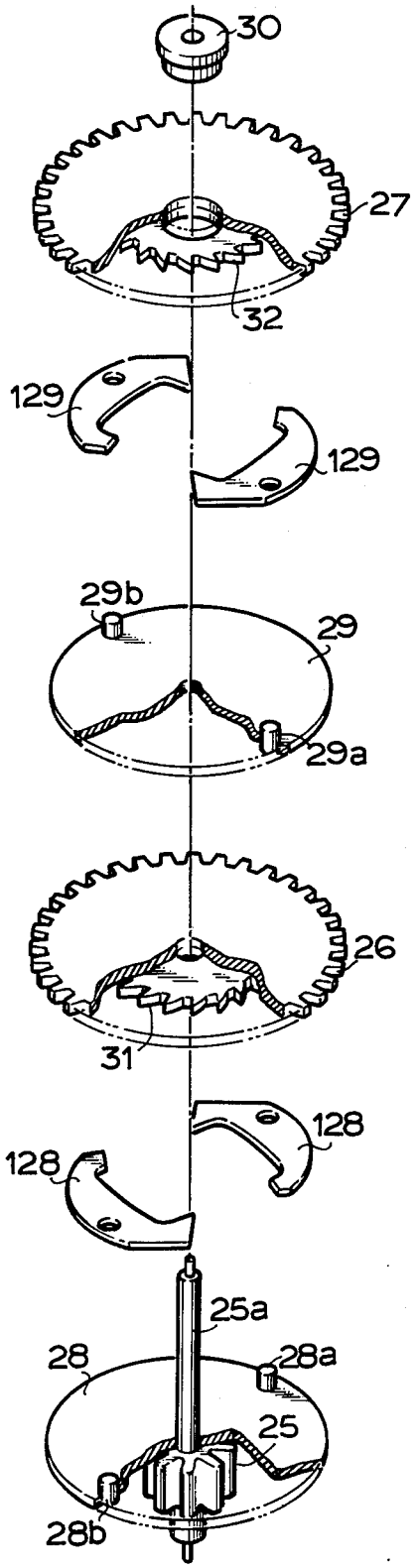
FIG. 5 is a perspective view showing brief parts disassembled of another embodiment of this invention.
Figure 6:
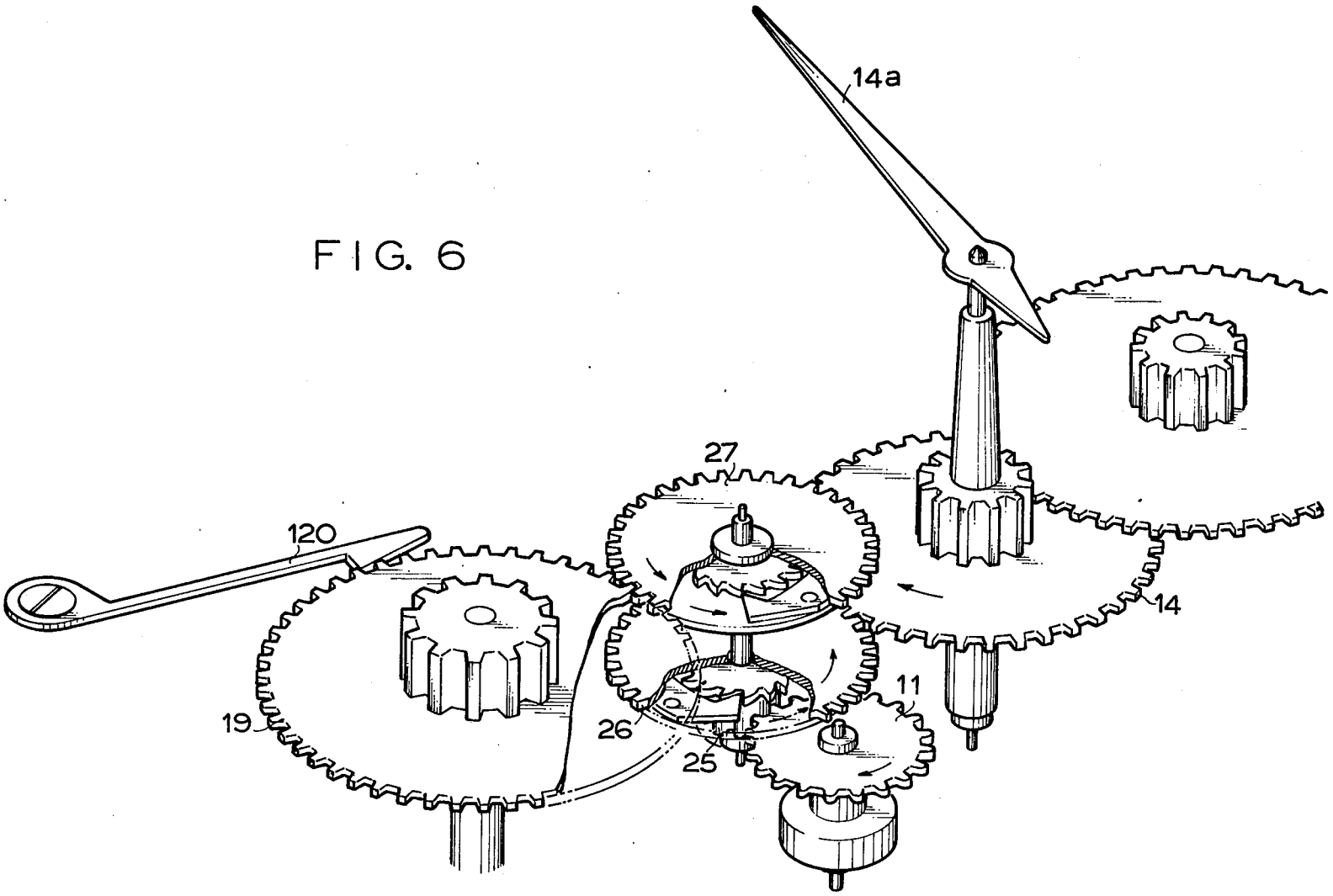
FIG. 6 is a perspective view showing brief parts assembled of FIG. 5.

FIGS. 5 and 6 show the second embodiment of this invention. In greater detail, FIG. 5 is a disassembled perspective view wherein the reverse rotation wheel 12 is substituted by a clutch wheel and FIG. 6 is a perspective view showing a brief part of wheel trains.

The clutch wheel in FIG. 5 will be explained. A lower disk 28, an upper disk 29 and a flange member 30 are fixed to a shaft 25*a* of a pinion 25. Two pins 28*a*, 28*b* are provided at the lower disk 28 and two pins 29*a*, 29*b* are provided at the upper disk 29. Two idle clasps 128*a*, 128*b* are idly inserted into the pins 28*a*, 28*b* respectively and two idle clasps 129*a*, 129*b* are also inserted into the pins 29*a*, 29*b* respectively. A lower ratchet 31 and an upper ratchet 32 are secured to a lower wheel 26 and an upper wheel 27 respectively. The ratchets are pivotably inserted into the shaft 25*a* of the pinion 25. The idle clasps 128*a*, 128*b* are engaged with the ratchets 31 and 32 respectively so as to drive the ratchets 31, 32 to effect a unidirectional rotation and an idle run of the reverse direction. In other words, the pinion 25 rotates in the counter-clockwise direction so that only the lower wheel 26 may be engaged to rotate while the upper wheel 27 runs idle. In reverse, the pinion 25 rotates in the clockwise direction so that only the upper wheel 27 is engaged to rotate while the lower wheel 27 runs idle.

The above operation will be described with reference to FIG. 6. When the pinion 25 is engaged with the pinion 11, the lower wheel 26 is engaged with the second hand wheel 14 and the upper wheel 27 is engaged with a date rotation wheel 19, the device of FIG. 6 may provide the same operation as that of the first embodiment. Namely, the pinion 25 is rotated in the counter-clockwise direction by means of the pinion 11 so that the lower wheel 26 may rotate the second hand wheel 14. While the pinion 25 is rotated in the clockwise direction so that the upper wheel 27 may rotate the date rotation wheel 19. In this case, it is possible to design the device with a small idle angle. During calendar feeding, use may be made of an index spring or a friction spring to support the second hand 14*a* for preventing it from flickering.

In order to lighten a load on the motor torque ratio for feeding a calendar member may be selected freely by using a reduction wheel. It may be easily attained by adjusting the time required to feed the second hand of the first embodiment for one minute, i.e., the rotation number of the motor per one minute. Further, the second function of this invention is applicable to the day of the week, month or year, or combination of the date and the day of the week as well as to the date. Furthermore, the calendar feeding means and the time correction synthesizing means 3 are constituted such that the date member may be fed for one through three days on a small month, i.e., a month having days less than 31 and such that the changeover means 4 may be driven to switch by a small month detection means associated with the calendar display mechanism and as the result, the concerned mechanism is prevented from being affected with unnecessary load so as to provide a permanent calendar.

In the above embodiments, the kept time is separated for the time display and the date display. Of course, it may be divided into more than three display functions, e.g., day of the week, month and year display functions. The timepiece of this invention enables free selection of the time and frequency required to drive the secondary function, and it is effective to change the current to timepiece signals in accordance with a purpose.

Further, the secondary functions, i.e., date and day of the week are processed together at a time and all of the primary function is regained later by the fast feeding so that the above embodiment is simpler.

In conclusion the feature of the invention is to divide the kept time of a timepiece with a plurality of functions so as to drive each function individually and thereby effecting effective utilization of energy by minimizing a burden on the electro-mechanical transducer and the elevation of its reliability by making the burden of the electrical system replace that of the mechanical system.

What is claimed is:

1. An electronic timepiece comprising:

(a) a reference signal source;

(b) an electronic counter connected to said reference signal source and having first and second outputs;

(c) a changeover means having a first input connected to the first output of said electric counter and a second input and an output;

(d) a calendar feed and time correction signal synthesizer connected between the second output of said electrical counter and the second input of said changeover means;

(e) an electro-mechanical transducer connected to the output of said changeover means;

(f) mechanical display driving means connected to said electro-mechanical transducer and having first, second and third outputs;

(g) a fixed time detector connected between said changeover means and the third output of said mechanical display driving means to form a feedback loop;

(h) a time display means connected to the first output of said mechanical display driving means; and (i) a calendar display means connected to the second output of said mechanical display driving means.

2. An electronic timepiece comprising:

(a) a time reference signal source generating a time reference signal;

(b) electrical counter means for frequency-dividing and counting said time reference signal providing first and second outputs;

(c) signal synthesizing means for receiving the second output signal from said electrical counter means and synthesizing a signal for driving an additional function display and correcting a time required to drive said additional function display, said signal synthesizing means providing an output signal;

(d) changeover means for selectively changing-over a time keep signal of the first output from said electrical counter means and said output signal from said signal synthesizing means and providing an output of the selected changeover time keep signal;

(e) an electro-mechanical transducer receiving the output signal from said changeover means and providing an output;

(f) display driving means for receiving the output of said transducer and providing a driving output;

(g) display means comprised of a time display mechanism and an additional function display mechanism which are selectively driven by the driving output of said display driving means; and (h) detecting means for feeding back an output signal from said display driving means to said changeover means for activating said changeover means.

3. The electronic timepiece as claimed in claim 2 wherein said electro-mechanical transducer is reversible.

4. The electronic timepiece as claimed in claim 2 wherein the first output signal of said electrical counter means causes forward rotation of said display driving means and the output signal of said signal synthesizing means causes said display driving means to rotate in a reverse direction.

5. The electronic timepiece as claimed in claim 2 wherein said display driving means is a wheel train.

6. The electronic timepiece as claimed in claim 4 wherein said display driving means is a wheel train.

7. The electronic timepiece as claimed in claim 2 wherein said additional function display is a calendar display means.

8. The electronic timepiece as claimed in claim 7 wherein said calendar display means is a date display means.

9. The electronic timepiece as claimed in claim 7 wherein said calendar display means is a day of the week display means.

10. The electronic timepiece as claimed in claim 7 wherein said calendar display means is a month display means.

11. The electronic timepiece as claimed in claim 7 wherein said calendar display means is a year display means.

12. The electronic timepiece as claimed in claim 7 wherein said calendar display means is provided with a means for preventing reverse rotation whereby said electro-mechanical transducer is rotated in forward and reverse rotation for a plurality of cycles so that said time display and calendar means are driven alternatively.

13. The electronic timepiece as claimed in claim 7 wherein said electro-mechanical transducer is driven by plural days required to correct the end of the month in months with those less than 31 days whereby an eternity calendar is provided.

14. The electronic timepiece as claimed in claim 1 wherein said mechanical display driving means is a wheel train.

* * * * *